United States Patent [19]

Sasayama et al.

[11] 4,150,643

[45] Apr. 24, 1979

[54] CAR EXHAUST GAS PURIFICATION DEVICE CONTROLLING CIRCUIT

[75] Inventors: Takao Sasayama, Hitachi; Torazo Nishimiya, Mito; Shinichi Sakamoto, Hitachi, all of Japan

[73] Assignee: Hitachi, Ltd., Japan

[21] Appl. No.: 756,715

[22] Filed: Jan. 4, 1977

[30] Foreign Application Priority Data

Jan. 21, 1976 [JP] Japan ..... 51/4957

[51] Int. Cl.[2] ..... F02M 7/24

[52] U.S. Cl. ..... 123/119 EC; 60/276

[58] Field of Search ..... 123/119 EC, 32 EE; 60/276, 285

[56] References Cited

U.S. PATENT DOCUMENTS

| | | | |
|---|---|---|---|
| 3,998,189 | 12/1976 | Aoki | 123/32 EE |
| 4,019,474 | 4/1977 | Nishimiya et al. | 123/32EE |
| 4,022,171 | 5/1977 | Laprade et al. | 123/119 EC |

*Primary Examiner*—Samuel Feinberg

*Attorney, Agent, or Firm*—Craig & Antonelli

[57] ABSTRACT

A car exhaust gas purification device controlling circuit wherein a deviation between an output of an exhaust gas sensor and a set value is converted into a time-width signal and a proportional electromagnetic valve is controlled by an integrated output of the time-width signal to control the air-fuel ratio around a theoretical air-fuel ratio, whereby an offset of air-fuel ratio due to hysteresis of such as the proportional electromagnetic valve used for controlling the air-fuel ratio is eliminated.

6 Claims, 8 Drawing Figures

CAR EXHAUST GAS PURIFICATION DEVICE CONTROLLING CIRCUIT

BACKGROUND OF THE INVENTION

1. Field of the Invention

This invention relates to a car exhaust gas purification device controlling circuit for automatically controlling the air-fuel ratio of carburetor type gasoline engines.

2. Description of the Prior Art

Generally, the amount of car exhaust gas pollutants including CO, HC and $NO_x$ is determined definitely by the air-fuel ratio. Accordingly, in view of the fact that poison-free treatment of the $NO_x$ gas is difficult, as general approach to solve this problem, there have been proposed various counter measures which are effective in the low generation density region of $NO_x$ gas i.e., thick mixture or thin mixture region, these countermeasures including improvements for fuel cost and operation efficiency. According to these conventional countermeasures, however, there still remain problems such as secondary pollution due to catalizers, degradation of operation efficiency due to decrease in output power and increase in the fuel cost, leaving behind many problems to be discussed for these countermeasures to be practised.

For the background as above, a gas purification system of new type is demanded which is capable of simultaneously decreasing the amount of $NO_x$, CO and HC without giving adverse affect upon the fuel cost and operation efficiency. In the circumstances, a system utilizing a ternary catalizer is highlighted as a promising measure, where the ternary catalizer is a single catalizer which can oxidize CO and HC and at the same time reduce $NO_x$.

FIG. 1 shows ternary characteristics of the ternary catalizer, where abscissa represents air-fuel ratio A/F and ordinate purification rate $\eta$ of the ternary catalizer. Purification rates $\eta NO_x$, $\eta CO$ and $\eta HC$ for respective pollutants $NO_x$, CO and HC have characteristics as shown in the figure. As will be seen from the characteristics, respective purification rates $\eta NO_x$, $\eta CO$ and $\eta HC$ are more than 90% at a theoretical air-fuel ratio and in proximity thereof. The theoretical air-fuel ratio referred to herein has the meaning of a weight ratio between a unity of fuel and a quantity of air necessary and sufficient for flaming the unitary fuel and it amounts to about 14.7. It will also be appreciated from FIG. 1 that the proximity of the theoretical air-fuel ratio lies within $\pm 0.1$. Accordingly, it is expected that the use of ternary catalizer offers a purification system of high performance.

From the above point of view, some systems have conventionally been proposed, of which a typical example is illustrated in FIG. 2. In accordance with this example, a ternary catalizer 3 is placed in an exhaust conduit 2 communicated with an engine 1, a gas sensor 4 for detecting one composition of exhaust gas, for example oxygen, is mounted to a portion of the exhaust conduit 2 upstream of the ternary catalizer, and the output of the gas sensor 4 is fed via a controlling circuit 5 to an electromagnetic valve 7 provided for a carburetor 6 to drive the valve 7, whereby the air-fuel ratio in the carburetor is controlled to the theoretical air-fuel ratio and proximity thereof at which the ternary catalizer reacts most efficiently. Needless to say, fuel is delivered to the electromagnetic valve 7 and air to the carburetor 6. In such a system, however, since the output of the gas sensor 4 eventually drives the electromagnetic valve 7 to vary an opening area A of an air bleed of the carburetor 6 thereby to control the air-fuel ratio, the operation takes the form of a proportional controlling with the result that the controlled air-fuel ratio is accompanied with an adverse offset as will be described later.

FIG. 3 is a graph showing occurrence of an offset in the air-fuel ratio to be controlled, where the abscissa represents controlling current $I_C$ for the electromagnetic valve and ordinates represent air-fuel ratio A/F, electromagnetic valve stroke S and air bleed opening area A. Air-fuel ratio A/F depends on a positional relationship between the stroke of the proportional electromagnetic valve and the air bleed but has a hysteresis width D as shown in FIG. 3 on account of the negative suction pressure and magnetic hysteresis of the electromagnetic valve. Consequently, for a controlling current $I_C$ of 0.4 amperes, for example, the air-fuel ratio drifts within 13.6 to 15.4, leading to positive and negative offsets relative to the theoretical air-fuel ratio of 14.7.

A similar technique to the conventional example as above is disclosed in the specification of U.S. Pat. Nos. 3,738,341 and 2,355,090. Systems disclosed in these patents have substantially the same construction as the above conventional example except that correction in view of oxygen concentration and acceleration are taken into consideration. Accordingly, these patents are disadvantageous, like the conventional example quoted hereinbefore, in that a complete controlling of the air-fuel ratio is not accomplished at the theoretical air-fuel ratio and in proximity thereof.

SUMMARY OF THE INVENTION

An object of this invention is to provide a car exhaust gas purification device capable of eliminating offset of the air-fuel ratio to be controlled.

Another object of this invention is to provide a car exhaust gas purification device having in feedback process a proportional element and an integration element for eliminating offset of the air-fuel ratio.

Still another object of this invention is to provide an inexpensive and highly reliable car exhaust gas purification device by eliminating adjustments for, for example, variations due to output characteristics of the output sensor.

DESCRIPTION OF THE PREFERRED EMBODIMENTS

Figure 4:
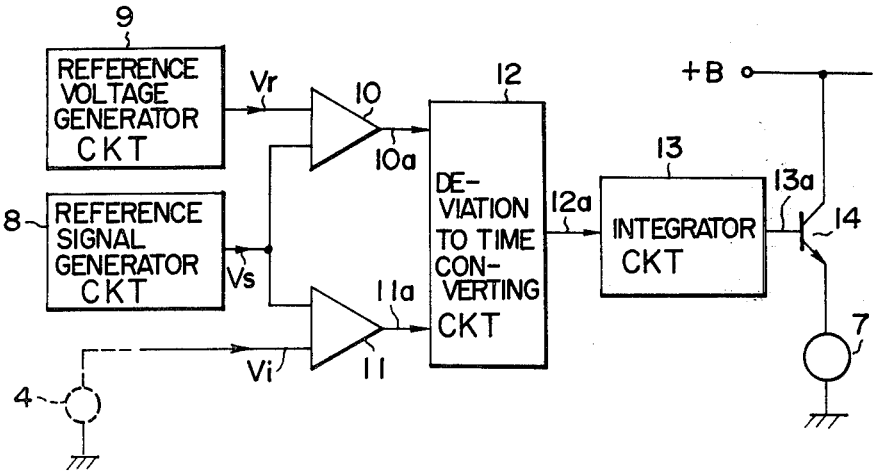
FIG. 4 is a block diagram of the first embodiment of car exhaust gas purification device according to the invention.

Referring now to FIG. 4, an exhaust gas purification device controlling circuit firstly embodying the present invention comprises a reference signal generator circuit 8 for generating a saw tooth wave form, a reference voltage generator circuit 9 for generating a reference voltage representative of a reference air-fuel ratio which is to be set within the range of magnitude of an output from a gas sensor 4, a comparator circuit 10 for comparing outputs derived from the generator circuits 8 and 9, a comparator circuit 11 for comparing outputs derived from the generator circuit 8 and the gas sensor 4, a deviation to time converting circuit 12 for calculating a deviation between the outputs derived from the two comparator circuits 10 and 11 thereby to convert a value of the deviation into a time width, and an integrating circuit 13 for integrating an output from the deviation to time converting circuit 12 with its integrated output fed to the input of a transistor 14 the emitter of which is connected with a proportional electromagnetic valve 7 provided for a carburetor 6. With this construction, the exhaust gas purification device controlling circuit operates as explained hereinafter.

The comparator circuits 10 and 11 each carry out the aforementioned comparison to produce a binary signal responsive thereto. More particularly, while the comparator circuit 10 compares an output signal Vs from the reference signal generator circuit 8 with an output signal Vr from the reference voltage generator circuit 9 and produces a logic signal "1" when $Vr - Vs > 0$ and a logic signal "0" when $Vr - Vs < 0$, the comparator circuit 11 compares an output signal Vi from the sensor 4 with the output signal Vs of the comparator circuit 8 and produces a logic "1" when $Vi - Vs > 0$ and a logic "0" when $Vi - Vs > 0$. When receiving binary signals 10*a* and 11*a*, the deviation to time converting circuit 12 produces a pulse signal 12*a* whose width is proportional to a deviation $Vi - Vr$ between the output signals Vi and Vr (this pulse signal is simply referred to as time-width signal hereinafter). Strictly speaking, however, the time-width signal 12*a* is not only defined by the deviation $Vi - Vr$ but also related to an inclination m of the saw tooth waveform signal Vs representative of the output of generator circuit 8. It will be appreciated that the period and inclination of the saw tooth waveform signal Vs are predeterminedly set and fixed and therefore, the inclination merely gives a coefficient term to the time-width signal 12*a*. This coefficient term determines the integrating time of the integrator 13, in other words, the average treatment interval of the integrating operation. In view of the fact that an optimum integrating interval is determined in advance of the operation, the inclination m and period of the saw tooth waveform signal Vs are set, as described above, on the basis of that previous determination.

Figure 1:
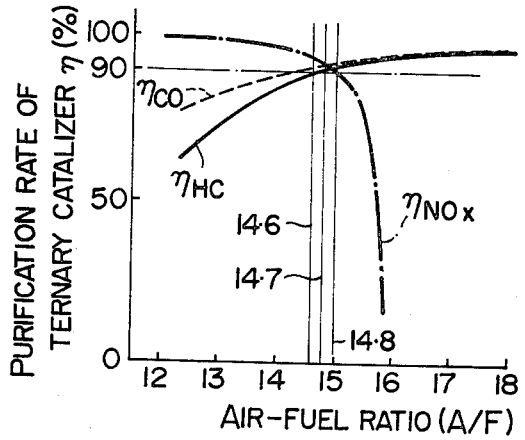
FIG. 1 is a graph to show gas purification rate characteristics of CO, HC and $NO_x$ with a ternary catalizer.
Figure 2:
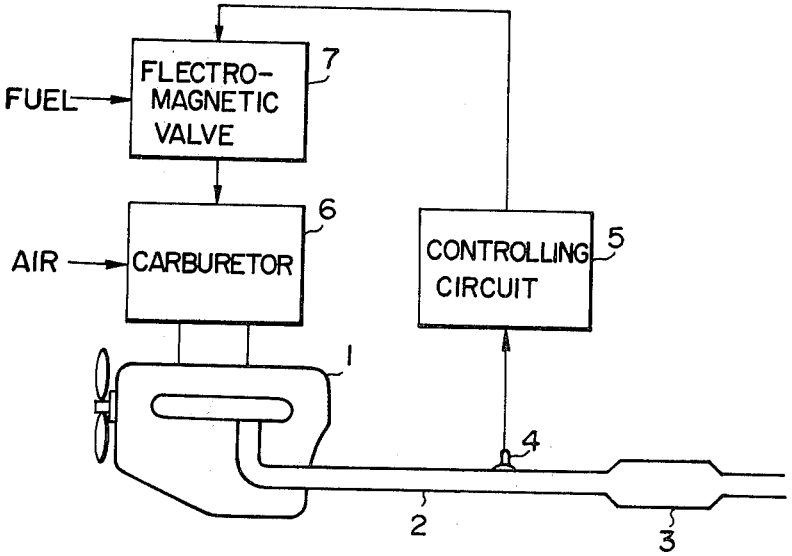
FIG. 2 PRIOR ART
FIG. 2 is a block diagram of a prior art car exhaust gas purification device.
Figure 3:
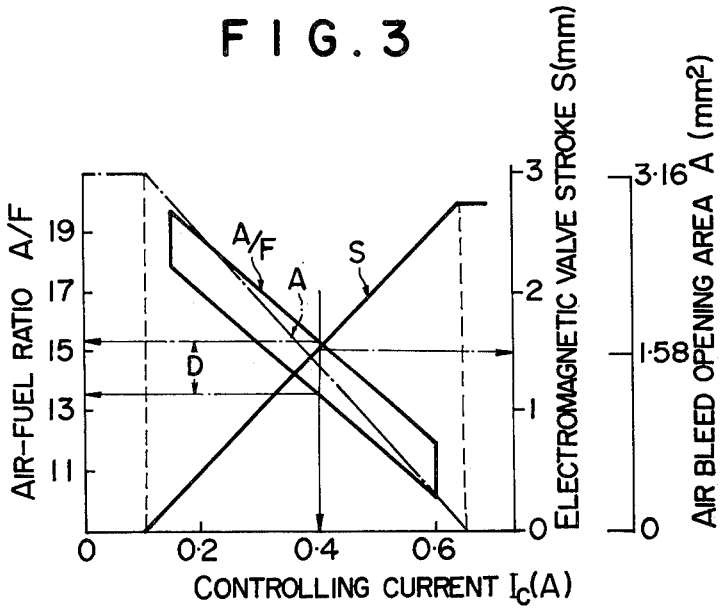
FIG. 3 is a graph to show offset of the air-fuel ratio to be controlled, where abscissa represents the electromagnetic valve controlling current and ordinates represent the air-fuel ratio, electromagnetic valve stroke and air bleed opening area.

The time-width signal 12*a* (actually, a pulse signal) derived from the deviation to time converting circuit 12 has a specific relationship with the integrator 13. This relationship is governed by the polarity of the deviation. That is to say, a positive integration is carried out when $Vi - Vr > 0$ and a negative integration is done when $Vi - Vr < 0$. Accordingly, a time-width signal is produced by the converting circuit 12 in response to the positive and negative polarities of the deviation and the integrator 13 will carry out a positive or negative integration in accordance with the polarities of the deviation. The integrator 13 also has a holding function which proceeds during absence of the time-width signal 12*a*. An output signal 13*a* of the integrator 13 obtained during the holding and integrating operation periods represents a signal identical to a detected signal Vi of the gas sensor 4 which is subjected to the proportional integration. The output signal 13*a* of integrator 13 is fed to the proportional electromagnetic valve 7 via the transistor 14 to control the actuation of the proportional electromagnetic valve 7. Assuming that a mean valve of the output signal 13*a* derived from the integrator 13 is Vc, the means value Vc is proportional to a terminal voltage across the proportional electromagnetic valve 7 i.e., a current flowing therethrough. In case where such a hysteresis curve as shown in FIG. 3 is involved in characteristics of the proportional electromagnetic valve 7, increase in the mean value Vc i.e., increase in an electromagnetic valve controlling current Ic controls the air-fuel ratio toward a low value i.e., a thick mixing ratio. Accordingly, the air-fuel ratio is controlled toward the thin mixing ratio side when $Vi - Vr > 0$ and toward the thick mixing ratio when $Vi - Vr < 0$ thereby to component circuits are the same as those of the first embodiment shown in FIG. 4.

Figure 5:
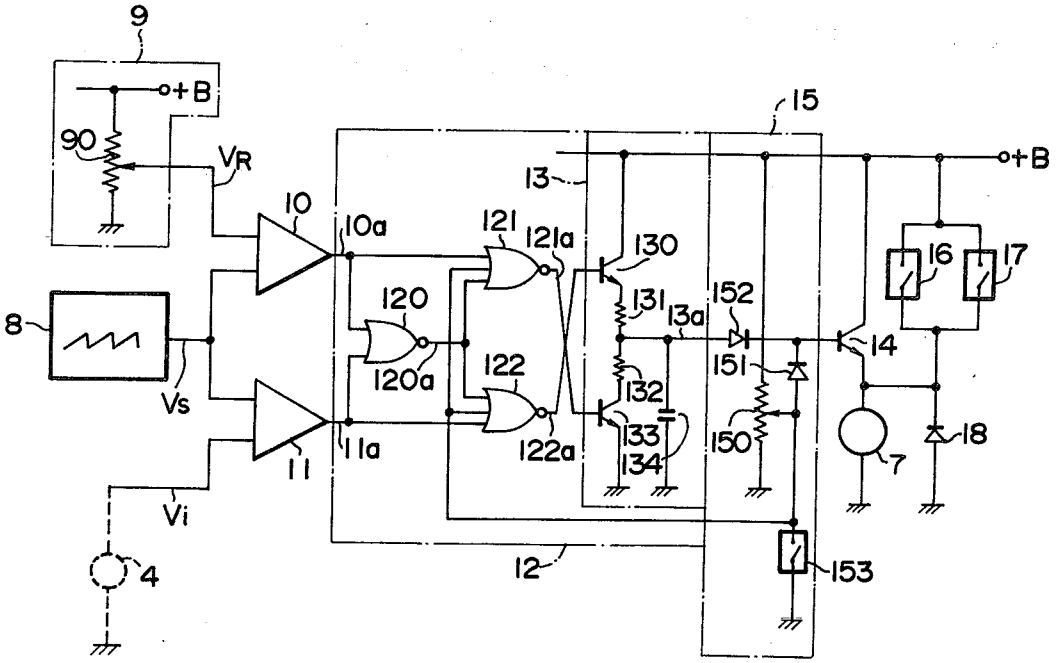
FIG. 5 is a circuit diagram of the second embodiment of car exhaust gas purification device according to the invention.

In addition to the above component circuits, the second embodiment of FIG. 5 comprises an adjuster circuit 15 including a voltage dividing resistor 150, diodes 151 and 152 and a normally-closed switch 153, switches 16 and 17, and a diode 18. The diode 18 serves to absorb a surge voltage which is generated when the proportional electromagnetic valve 7 is deenergized. Of the additional switches, the normally-closed switch 153 is opened when the negative pressure in the engine intake conduit is high, the switch 16 is a normally-opened switch which is closed cooperatively with the choke valve of carburetor during choking, and the switch 17 is a normally-opened switch which is closed cooperatively with the fuel enrichment mechanism of the carburetor when increased supply of fuel is desired, for example, during high speed running. All of these switches are adapted to establish a circuit for making invalid the whole controlling system thereby to realize a thick mixture state when the engine is in warm-up operation or a high output for acceleration is required.

Figure 6:
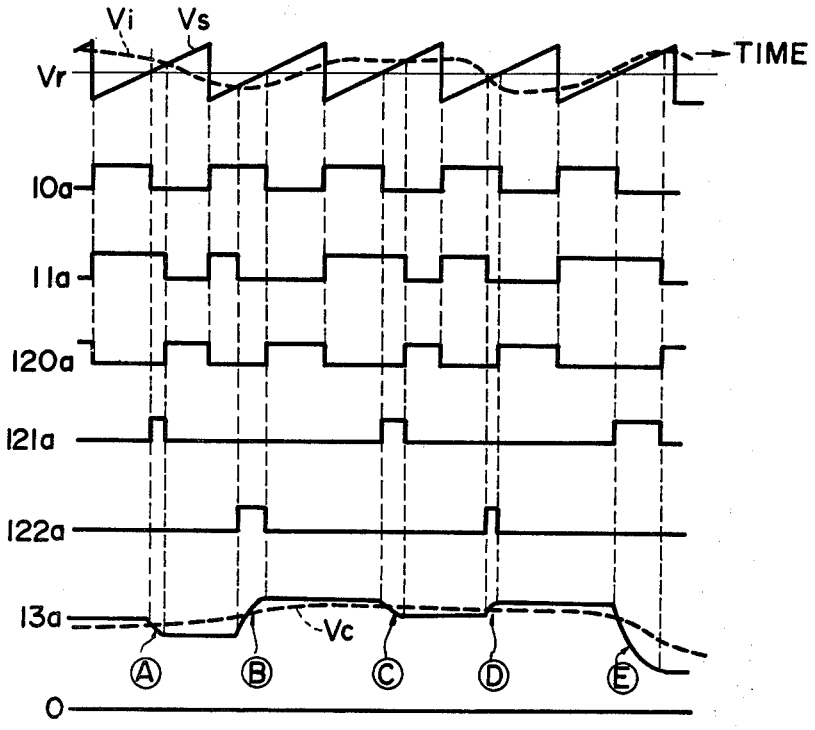
FIG. 6 shows voltage waveforms at essential parts of the embodiments of FIGS. 4 and 5.

In operation, with reference to FIG. 6 showing waveforms of each component circuit, when the engine is neither under idling i.e., warm up nor acceleration, that is to say, the car is running at an ordinary speed, the switch is closed while the switches 16 and 17 being opened. At this time, the comparison between voltages Vr and Vs is carried out in the comparator circuit 10 and the comparison between voltages Vi and Vs is carried out in the comparator 11. As has been explained hereinbefore, since the comparator circuit 10 produces a logic "1" when $Vr \geqq Vs$ and a logic "0" when $Vr < Vs$, the output signal 10*a* of the comparator circuit 10 takes a waveform as shown at 10*a* in FIG. 6. The comparator circuit 12 produces a logic "1" when $Vi \geqq Vs$ and a logic "0" when $Vi < Vs$, delivering the output signal 11*a* as shown at 11*a* in FIG. 6.

The output signals 10*a* and 11*a* of comparator circuits 10 and 11 are applied to the NOR gate 120, 121 and 122 in the deviation to time converting circuit 12. The NOR gate 120 first performs a NOR gate operation under the reception of signals 10*a* and 11*a*, delivering an output signal 120*a*. The NOR gate 121 is applied with the output signals 10*a* and 120*a* as well as zero potential or a logic "0" through the switch 153. Under the application of the three logic inputs, the NOR gate 121 performs a gating operation, delivering an output signal 121*a*. The NOR gate 122 is applied with the output signals 11*a* and 120*a* as well as zero potential or a logic "0" through the switch 153. Under the application of the three logic inputs, the NOR gate 122 performs a gating operations, delivering an output signal 122*a*. As will be seen from FIG. 6, while the output signal 121*a* of the NOR gate 121 assumes logic "1" only when $Vr < Vs \leqq Vi$, the output signal 122*a* does so only when $Vi < Vs \leqq Vr$. When the inclination of the saw tooth waveform voltage Vs is m, a time interval ΔT through which the NOR gates 121 and 122 deliver logics "1" is expressed by the following equation, $$\Delta T = (|Vr - Vi|/m) = (|\Delta V|/m) \quad (1)$$

where $|\Delta V| = |Vr - Vi|$. In other words, a signal having a pulse width proportional to the deviation ΔV between the reference voltage Vr and the gas sensor output voltage is delivered from respective NOR gates 121 and 122.

Assuming now that values of the gas sensor output Vi become larger toward the thicker mixture side, the input transistors 133 and 130 of the integrator 13 operate under the reception of output signals 121*a* and 122*a* in such a manner that the transistor 133 is turned on and the transistor 130 is turned off when the present mixing ratio is on the thick mixture side relative to the reference mixing ratio determined by the reference voltage and when the present mixing ratio is on the thin mixture side relative to the reference mixing ratio, the transistor 130 is turned on and the transistor 133 is turned off. Respective transistors 133 and 130 are conductive during the time interval of T as defined above. With only the transistor 130 turned on, the capacitor 134 is charged with a voltage approximate to the power source +B via the resistor 131 whereas with only the transistor 133 turned on, the charge stored in the capacitor 134 is discharged through the resistor 132. In other words, the terminal voltage across the capacitor 134 stands for the output signal of the integrator 13 which is depicted at 13*a* in FIG. 6. As shown in FIG. 6, intervals through which the terminal voltage 13*a* is discharged by the output signal 121*a* of NOR gate 121 are designated at symbols A, C and E, and intervals through which the capacitor 134 is charged are designated at symbols B and D. At respective intervals A, C and D, the time interval between a crosspoint of the signals Vr and Vs and a crosspoint of the signals Vs and Vi varies to a relatively small extent so that the output signal 13*a* undergoes a relatively small variation. On the other hand, at respective intervals B and E, the time interval between a crosspoint of the signals Vr and Vs and a crosspoint of the signals Vs and Vi varies to a great extent so that the output signal 13*a* varies greatly.

The magnitude of terminal voltage 13*a* across the capacitor 134 is proportioned to the voltage across the proportional electromagnetic valve 7 i.e., the electromagnetic valve current. In case where use is made to a proportional electromagnetic valve having characteristics as shown in FIG. 3, increase in the terminal voltage 13*a* i.e., increase in the proportional electromagnetic valve current controls the air-fuel ratio toward a low value, that is to say, toward a thick mixing ratio. Accordingly, the air-fuel ratio is controlled toward the thin mixture side when $Vi > Vr$ and is controlled toward the thick mixture side when $Vi < Vr$, so that a balance is kept. This means that the air-fuel ratio is maintained at a theoretical air-fuel ratio of 14.7. Additionally, the diode 152 serves to absorb a large electromotive force generated by a self-inductance of a coil of the proportional electromagnetic valve when the valve current is decreased rapidly, thereby preventing the transistor 14 from being broken down.

On the other hand, when the engine is under an idling state, the normally-closed switch 153 is opened and one of logic inputs to respective NOR gates 121 and 122 assumes a logic "1". As a result, the transistors 133 and 130 are kept turned off. In addition, the base of the transistor 14 can take a predetermined potential which is determined by a slider of the voltage divider resistor (potentiometer) 150 through the diode 151. Accordingly, by previously setting the voltage dividing resistor 150 to a position at which a proportional electromagnetic valve controlling current giving an air-fuel ratio suitable for the idling is obtained, it is possible to keep constantly a predetermined air-fuel ratio state during idling.

While the choke is actuated or the power mechanism is in operation, on the other hand, the switches 16 and 17 are switched on to allow the proportional electromagnetic valve controlling current to reach a maximum value with the result that the air-fuel ratio is set to a minimum value which is determined by the air bleed of the carburetor.

In the foregoing first and second embodiments of the present invention, the saw tooth wave form having the inclination angle m has been used as the signal of the reference signal generator circuit, but the invention is not limited to the usage of a saw tooth waveform and objects and effects of the invention set forth above can be attained similarly in case of the usage of a triangular waveform.

Figure 7:
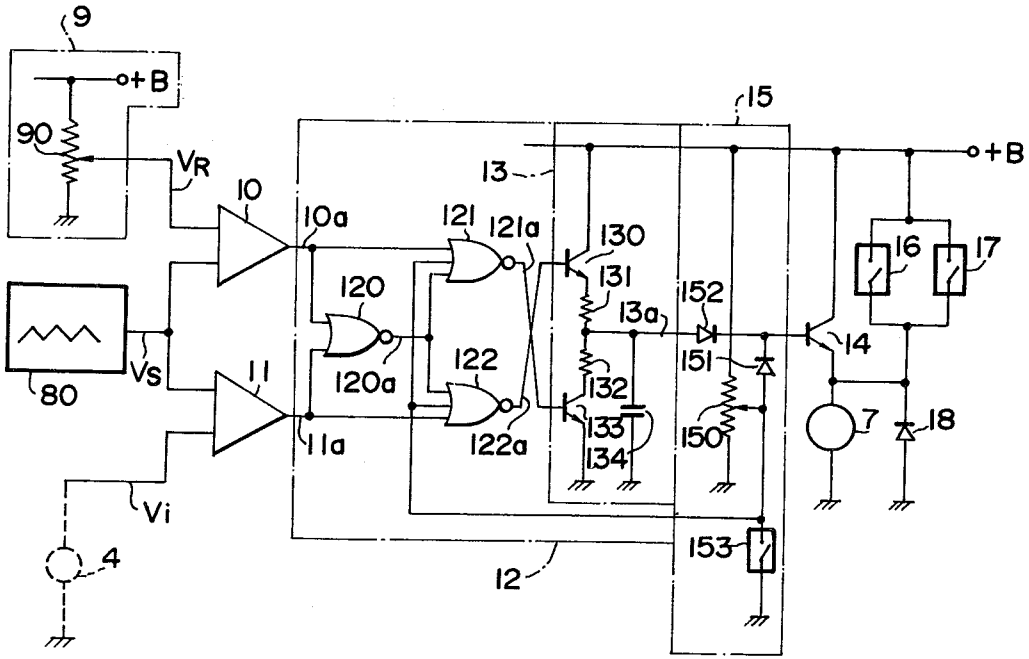
FIG. 7 is a circuit diagram of a modification of the embodiment of FIG. 5.
Figure 8:
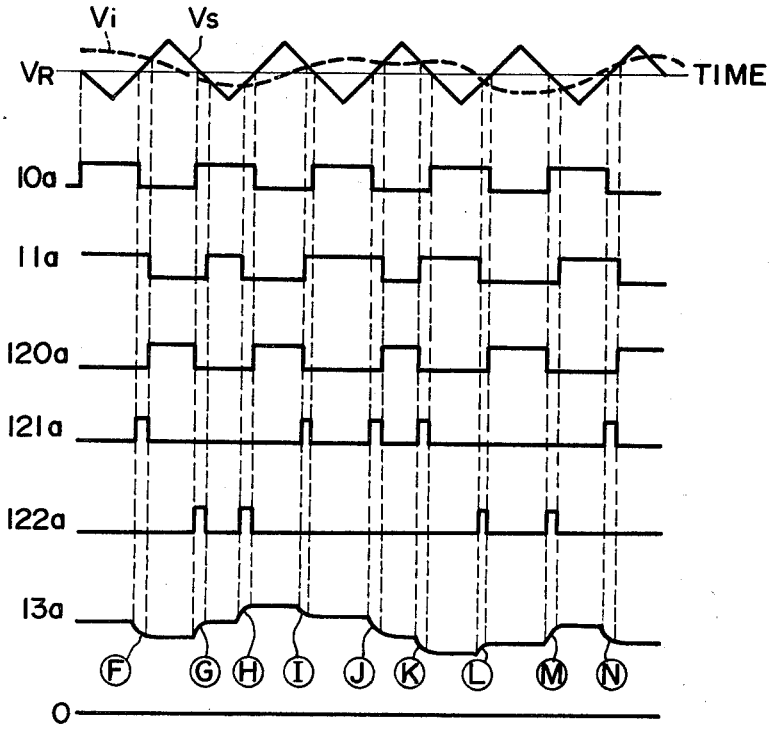
FIG. 8 shows voltage waveforms at essential parts of the modified embodiment of FIG. 7.

Referring to FIGS. 7 and 8, a further embodiment of the invention will be described wherein a triangular waveform is used as the reference signal. A circuit arrangement as shown in FIG. 7 is the same as FIG. 5 except a triangular waveform generator circuit 80, and it operates in the same manner. FIG. 8 shows waveforms obtainable in a similar manner to FIG. 6 but it will be seen from the output waveform 13*a* of the integrating circuit 13 that the triangular waveform permits a more precise control of the electromagnetic valve than the saw tooth waveform does.

It should also be noted that the intended objects and effects can be attained even with a sinusoidal wave as the reference signal and, in short, any alternating signals with finite voltage variation rate may be used as the reference signal.

As has been described in detail, it is possible to control the air-fuel ratio within a relatively narrow range around the medium of theoretical air-fuel ratio by converting the deviation between the exhaust gas sensor output and the set value into the time-width signal and driving the proportional electromagnetic valve by the integrated output of the time-width signal to control the air-fuel ratio in carburetor. Further, the operation is carried out in the form of a proportional integration control so that an offset free and accurate controlling of the air-fuel ratio can be assured. The controlling circuit of the invention which requires no adjustment assures low cost and high reliability and is suitable for use in mass-produced parts such as car parts; and further, it permits a large allowance for design and incorporation of various compensation circuits required for the carburetor, making it possible to be a highly practical circuit.

We claim:

1. A car exhaust gas purification device controlling circuit comprising an exhaust gas sensor for detecting at least one composition gas in the exhaust gas, a first generator circuit for generating an alternating signal with a finite voltage variation rate of fixed period, a second generator circuit for generating a signal with a predetermined level, a first comparator circuit for comparing a detection output of the exhaust gas sensor with an output of the first generator circuit to produce a binary signal in accordance with results of a first comparison, a second comparator circuit for comparing an output of the second generator circuit with the output of the first generator circuit to produce another binary signal in accordance with results of a second comparison, a deviation to time converting circuit connected to receive two binary signals representative of outputs of the first and second comparator circuits for calculating a deviation between the two binary signals in the form of a time width thereby to effect a deviation to time conversion, an integrator circuit for integrating an output of the deviation to time converting circuit, and an electromagnetic valve provided for a carburetor and driven by a signal corresponding to an output of the integrator circuit, whereby the electromagnetic valve is driven to control a weight percent of air-fuel mixture supplied to an engine to a predetermined theoretical air-fuel ratio and proximity thereof.

2. A car exhaust gas purification device controlling circuit according to claim 1, wherein the carburetor has a predetermined air-fuel ratio by the actuation of switching means for delivering a predetermined voltage signal to the electromagnetic valve when a choking mechanism or power mechanism is in operation.

3. A car exhaust gas purification device controlling circuit according to claim 1, wherein when the engine is under the idling state, switching means for interrupting the input to the integrator circuit is actuated to deliver a predetermined signal to the electromagnetic valve thereby to drive it, whereby a predetermined air-fuel ratio is obtained during idling.

4. A car exhaust gas purification device controlling circuit according to claim 1, wherein the output of said integrator circuit is applied to the input of a transistor circuit connected in series with said electromagnetic valve in relation to a circuit power source.

5. A car exhaust gas purification device controlling circuit according to claim 2, wherein said switch means for delivering the predetermined voltage signal to said electromagnetic valve comprises normally-opened switch circuits connected in series with said electromagnetic valve in relation to a circuit power source.

6. A car exhaust gas purification device controlling circuit according to claim 3, wherein said switch means for interrupting the input to said integrator circuit comprises a normally-closed short-circuited switch circuit for grounding the input of said deviation to time converting circuit thereby to make invalid the output of said converting circuit and a predetermined division of a circuit power source voltage by resistor means is applied to the input of the transistor circuit connected in series with said electromagnetic valve in relation to the circuit power source when the short-circuited switch circuit is actuated.

* * * * *